US012351995B2

(12) United States Patent
Koenen et al.

(10) Patent No.: US 12,351,995 B2
(45) Date of Patent: Jul. 8, 2025

(54) AUTO SCRATCH HEIGHT FOR WORK MACHINES

(71) Applicant: Caterpillar Paving Products Inc., Brooklyn Park, MN (US)

(72) Inventors: Paul J. Koenen, Andover, MN (US); Nathaniel S. Doy, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 456 days.

(21) Appl. No.: 17/731,634

(22) Filed: Apr. 28, 2022

(65) Prior Publication Data

US 2023/0349111 A1 Nov. 2, 2023

(51) Int. Cl.
*E01C 23/088* (2006.01)

(52) U.S. Cl.
CPC ..... *E01C 23/088* (2013.01)

(58) Field of Classification Search
CPC ... E01C 23/088; E01C 23/127; G01B 11/022; G01B 11/14; E02F 3/847; E02F 9/2041; E02F 9/264; E02F 9/265
See application file for complete search history.

(56) References Cited

U.S. PATENT DOCUMENTS 6,152,648 A 11/2000 Gfroerer et al.
7,814,670 B2 10/2010 Katayama et al.
8,424,972 B2 4/2013 Berning et al.
8,788,157 B2 7/2014 Shintani et al.
8,899,689 B2 12/2014 Killion
9,121,146 B2 9/2015 Paulsen et al.
9,121,148 B2 9/2015 Johnson
9,206,566 B2 12/2015 Killion
9,540,786 B2 1/2017 Ogawa
9,656,530 B2 5/2017 Busley et al.
10,266,996 B2 4/2019 Hogan et al.
10,273,642 B2 4/2019 Berning et al.
10,456,883 B2 10/2019 Rivers et al.
10,465,346 B2 11/2019 Hoffmann et al.
10,519,631 B2 12/2019 Forcash et al.
10,876,260 B2 12/2020 Muir et al.
11,091,887 B1 8/2021 Hogan
(Continued)

FOREIGN PATENT DOCUMENTS

DE 10203732 A1 8/2003
DE 102015111249 A1 1/2017
(Continued)

*Primary Examiner* — Janine M Kreck

(57) ABSTRACT

A machine for roadwork can include a frame, a power source, and a milling rotor that can be operatively connected to the power source and the frame. The machine for roadwork can also include at least one camera and an image processor. The at least one camera can be configured to capture one or more images of the milling rotor. The image processor can be in communication with the at least one camera. The image processor may be configured to analyze the one or more images of the milling rotor captured by the at least one camera. The image processor may also be configured to determine a scratch height of the milling rotor based on one or more images. The scratch height can define a height of the milling rotor on condition that the milling rotor is in contact with a surface of the roadway.

16 Claims, 5 Drawing Sheets

(56) References Cited

U.S. PATENT DOCUMENTS

| | | | | |
|---|---|---|---|---|
| 11,220,796 | B2 | 1/2022 | Hirman et al. | |
| 2008/0153402 | A1* | 6/2008 | Arcona | B24B 49/04 451/352 |
| 2019/0330825 | A1 | 10/2019 | Tanimoto et al. | |
| 2020/0308781 | A1* | 10/2020 | Doy | E01C 23/065 |
| 2020/0308782 | A1* | 10/2020 | Doy | E01C 23/127 |
| 2021/0131075 | A1 | 5/2021 | Kumakura et al. | |
| 2021/0238813 | A1* | 8/2021 | Hogan | E01C 23/088 |
| 2021/0299807 | A1 | 9/2021 | Doy | |
| 2022/0064879 | A1* | 3/2022 | Stahl | G01C 21/12 |

FOREIGN PATENT DOCUMENTS

| | | | | |
|---|---|---|---|---|
| DE | 102021108425 | A1 * | 10/2021 | E01C 23/01 |
| DE | 102021115621 | A1 | 12/2021 | |

* cited by examiner

AUTO SCRATCH HEIGHT FOR WORK MACHINES

TECHNICAL FIELD

This disclosure relates to a work machine. More specifically, this disclosure relates to a work machine used to work on roadways.

BACKGROUND

Asphalt, concrete, or cement-surfaced roadways are built to facilitate vehicular travel. Depending upon usage density, base conditions, temperature variation, moisture variation, and/or physical age, the surface of the roadways eventually become misshapen, non-planar, unable to support wheel loads, or otherwise unsuitable for vehicular traffic. In order to rehabilitate the roadways for continued vehicular use, spent asphalt, concrete, or cement is removed in preparation for resurfacing.

Cold planers, sometimes also referred to as road mills, scarifiers, or reclaimers, are machines that typically include a frame propelled by tracked drive units. The frame supports an engine, an operator's station, and a milling rotor. The milling rotor, fitted with cutting tools, is rotated through a suitable interface by the engine to break up the surface of the roadway. The broken-up roadway material is deposited by the milling rotor onto a conveyor, or series of conveyors, that transport the material away from the machine and to a nearby haul vehicle for transportation away from the job site.

Control modules are provided in machines such as cold planers to operate the milling rotor and to control certain mechanisms associated with the machine. However, it is common for the operation of cold planers to require at least one operator on the road level to determine a scratch position (i.e., a height of the milling rotor on condition that the milling rotor is in contact with a surface of a roadway). The scratch position may be used as a zero-point by the control modules on the machines. Thus, an accurate scratch position may help the control modules on the machine more accurately measure the milling depth of the machine.

U.S. Pat. No. 10,876,260 to Muir et al. discusses an implement with a ground-engaging tool that may include a frame supported above a surface of a ground by a ground-engaging portion and a suspension and a tool supported by and adjustable relative to the frame and configured for working on the ground. The implement may also include a plurality of ground sensors configured for capturing distance measurements to determine the position of the frame relative to the surface and a control and monitor system configured for establishing a nominal scratch position of the tool relative to the surface based on the distance measurements.

SUMMARY OF THE INVENTION

In one example, a machine for roadwork can include a frame, a power source, and a milling rotor that may be operatively connected to the power source and the frame. The machine for roadwork can also include at least one camera and an image processor. The at least one camera can be configured to capture one or more images of the milling rotor. The image processor can be in communication with the at least one camera. The image processor may be configured to analyze the one or more images of the milling rotor captured by the at least one camera. The image processor may also be configured to determine a scratch height of the milling rotor based on one or more images. The scratch height can define a height of the milling rotor on condition that the milling rotor is in contact with a surface of the roadway.

In another example, a method of automatically detecting scratch height on a work machine, the work machine including a frame, a power source, and a milling rotor operatively connected to the power source and the frame. The method may include capturing one or more images of the milling rotor with a camera and analyzing with an image processor the one or more images captured by the camera. The method may also include determining a scratch height of the milling rotor based on the one or more images. The scratch height can define a height of the milling rotor on condition that the milling rotor is in contact with a surface of a roadway.

In yet another example, a work machine can include a frame, a power source, and a milling rotor operatively connected to the power source and the frame. The work machine may also include at least one camera configured to capture one or more images of the milling rotor. The work machine may also include means for determining a scratch height of the milling rotor. The means for determining the scratch height of the milling rotor can include analyzing one or more images of the milling rotor captured by the at least one camera and determining a scratch height of the milling rotor based on the one or more images. The scratch height can define a height of the milling rotor on condition that the milling rotor is in contact with a surface of a roadway.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
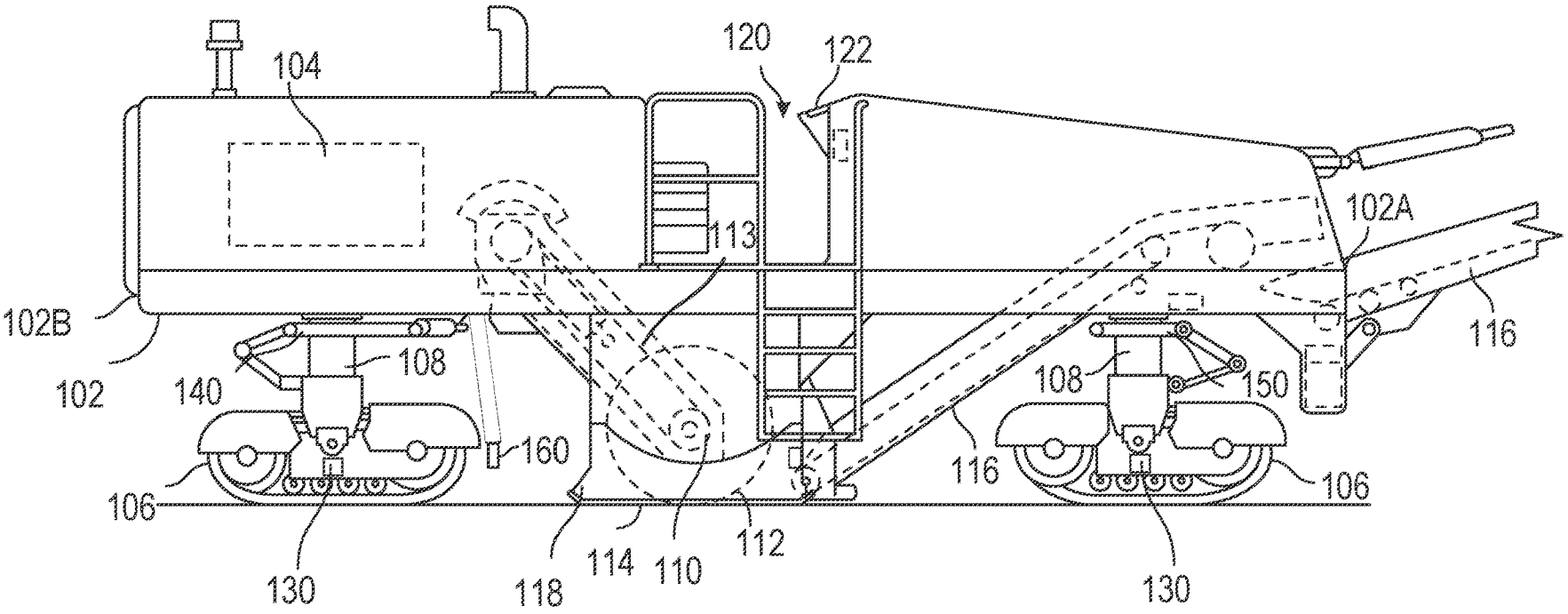
FIG. 1 illustrates a schematic side view of an example of a work machine.

FIG. 1 illustrates a schematic side view of an example of a work machine 100. The work machine 100 can include a frame 102, a power source 104, a plurality of ground engaging units (hereinafter referred to as "ground-engaging units 106"), and a plurality of vertically movable legs (hereinafter referred to as "vertically-movable legs 108"). The power source 104 can be connected to the frame 102. The ground-engaging units 106 can be connected to the frame 102 by the vertically-movable legs 108. In the example of FIG. 1, the work machine 100 can be a cold planer. In another example, the work machine 100 can be any other machine used for roadwork.

The frame 102 can longitudinally extend between a first end 102A and a second end 102B. The power source 104 can be provided in any number of different forms including, but not limited to, internal combustion engines, electric motors, hybrid engines, or any power source used to power construction equipment. Power from the power source 104 can be transmitted to various components and systems of the work machine 100, such as the ground-engaging units 106 or a milling assembly 110.

The frame 102 can be supported by the ground-engaging units 106 via the vertically-movable legs 108. The ground-engaging units 106 can be any kind of ground-engaging device that allows the work machine 100 to move over a ground surface such as a paved road or a ground already processed by the work machine 100. For example, as shown in FIG. 1, the ground-engaging units 106 can be configured as track assemblies or crawlers. In other examples, the ground-engaging units 106 can be configured as wheels, such as inflatable or hard tires, or any other ground-engaging device used for navigating construction vehicles.

The ground-engaging units 106 can be configured to move the work machine 100 in forward and backward directions along the ground surface. The vertically-movable legs 108 can be configured to raise and lower the frame 102 relative to the ground-engaging units 106 and the ground. One or more of the vertically-movable legs 108 can be configured to rotate about their central axis to provide steering for the work machine 100.

The work machine 100 can include multiple ground-engaging units 106, for example, four: a front left ground-engaging unit, a front right ground-engaging unit, a rear left ground-engaging unit, and a rear right ground-engaging unit, each of which can be connected to vertically-movable legs 108, respectively. As shown in FIG. 1, the work machine 100 can include four of the ground-engaging units 106 and four of the vertically-movable legs 108 where two of the ground-engaging units 106 and two of the vertically-movable legs 108 are located further into the plane of FIG. 1 and so are not shown. However, in other examples, the work machine 100 can utilize fewer than four of the ground-engaging units 106, such as three. The present disclosure is not limited to any particular number of ground-engaging units or vertically-moveable legs.

The vertically-movable legs 108 can be provided to raise and lower the frame 102 to, for example, control a cutting depth of a milling rotor 112 and to accommodate the work machine 100 engaging obstacles on the ground.

The work machine 100 can include the milling assembly 110 connected to the frame 102. The milling assembly 110 can include a milling rotor 112. The milling rotor 112 can be operatively connected to the power source 104. The milling rotor 112 can include a plurality of cutting tools 111 (first shown in FIG. 3) such as chisels, or milling bits disposed thereon the periphery of the milling rotor 112. The milling rotor 112 can be rotated about its center axis. As the milling rotor 112 rotates, the cutting tools 111 can engage a work surface 114. The work surface 114 can be asphalt, concrete, or any other material used to make existing roadways, bridges, parking lots, or any other concrete, cement, asphalt, or any combination thereof, surface. Moreover, as the milling rotor 112 engages the work surface 114, the cutting tools 111 can remove layers of materials forming the work surface 114, such as hardened dirt, rock, or pavement. The spinning action of the milling rotor 112 and the cutting tools 111 can transfer the material of the work surface 114 onto a conveyor system 116. The conveyor system 116 can remove the material from near the milling rotor 112 and carries the material away from the milling rotor 112 to be deposited in a receptacle. For example, the receptacle can be a box of a dump truck.

The work machine 100 can also include a pair of side plates (hereinafter referred to as "side plates 118"). The side plates 118 can act as lateral covers to the milling assembly 110 and the milling rotor 112. Thus, the milling rotor 112 can be located between the side plates 118.

Figure 2:
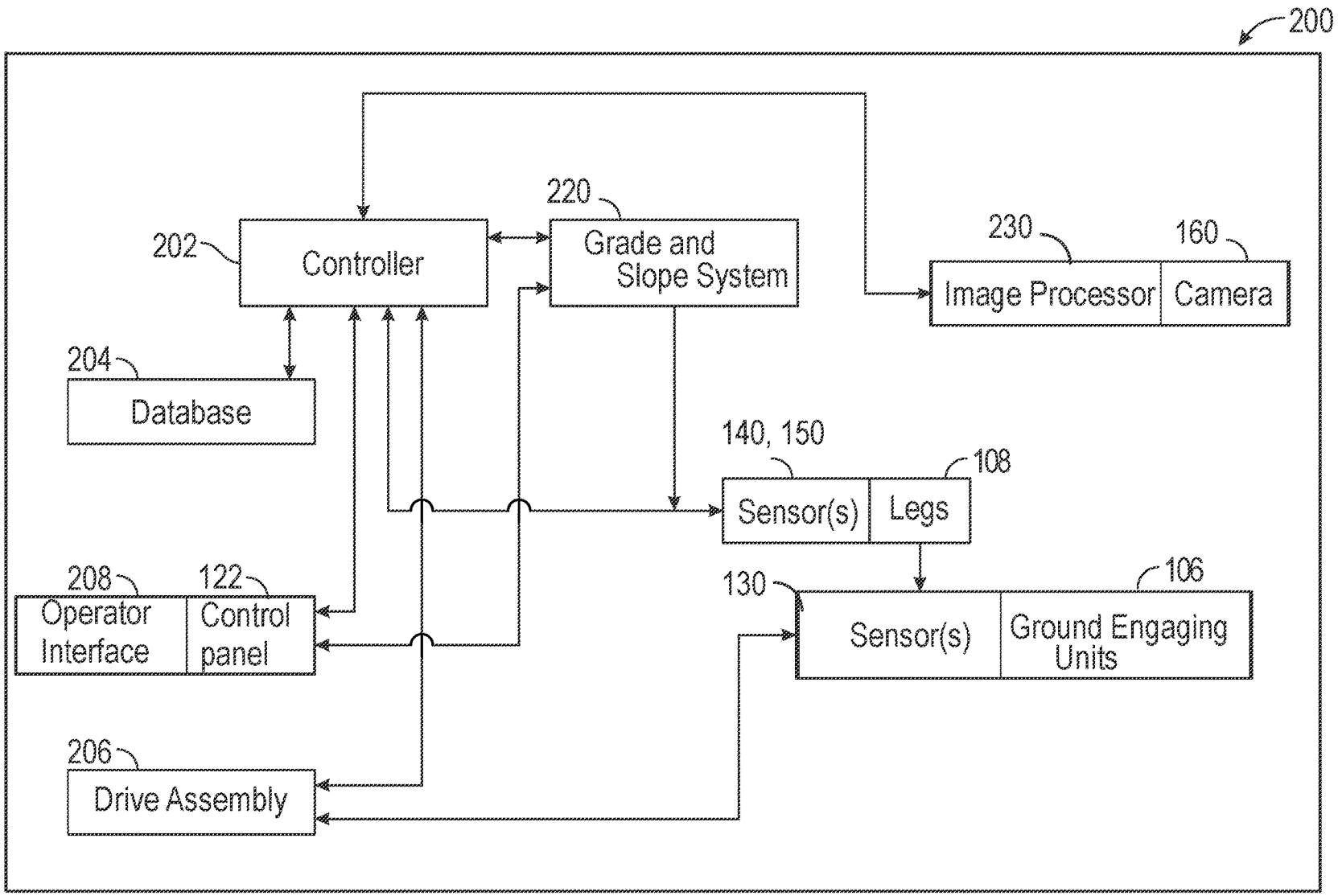
FIG. 2 illustrates a schematic diagram of a control system for a work machine.

The work machine 100 can include sensors that communicate to a control system 200 (FIG. 2). For example, the ground-engaging units 106 of the work machine 100 can include a sensor 130. The sensor 130 on the ground-engaging units 106 can be an optical or magnetic sensor (e.g., a proximity sensor), or any other sensor used to measure rotational speed of the ground-engaging units 106.

In another example, the work machine 100 can include a vertical motion sensor 140 to detect vertical movement of the work machine 100. The vertical motion sensor 140 can be mounted on the frame 102, either of the side plates 118, or the inboard ski 113. The vertical motion sensor 140 can be a position sensing hydraulic cylinder, linear variable differential transformer, a piezoelectric transducer, a laser doppler vibrometer, an eddy-current sensor, or any other sensor used to detect vertical motion.

In another example, at least one of the side plates 118 can include a sensor 150 that is configured to measure the cutting depth of the work machine 100. The sensor 150 can be position-sensing hydraulic cylinders, contact sensors, or any other sensor to determine cutting depth.

In another example, the milling assembly 110 can include an inboard ski 113. The inboard ski 113 can be connected to the milling rotor 112 and can optionally include the sensor 150. The sensor 150 can be a slope sensor, a contact sensor, position-sensing hydraulic cylinders, or any other sensor that can be used to detect the cutting depth.

In another example, the work machine 100 can include one or more scanning sensor 160 configured to capture one or more scans (e.g., images or data collected from a perception scanner) of the milling rotor 112 of the work machine 100 to show a position of the milling rotor 112 and cutting tools 111 in relation to the work surface 114. The one or more scanning sensor 160 can be a camera, radar, or a combination thereof including any other perception sensors. The one or more scanning sensor 160 can be attached to the frame 102 of the work machine 100. The above-mentioned sensors are solely examples of sensors that the work machine 100 can include and is not in any way an exhaustive list of sensors that the work machine 100 can include.

The work machine 100 can further include an operator station or a platform 120 including a control panel or a human-machine interface (hereinafter referred to as "control panel 122") for inputting commands to the control system 200 for controlling the work machine 100, and for outputting information related to an operation of the work machine 100. As such, an operator of the work machine 100 can perform control and monitoring functions of the work machine 100 from the platform 120, such as by observing various data output by various sensors located on the work machine 100. Furthermore, the control panel 122 can include controls for operating the ground-engaging units 106 and the vertically-movable legs 108.

The work machine 100, as well as other exemplary road construction machines such as rotary mixers, can include further components not shown in the drawings, which are not described in further detail herein. For example, the work machine 100 can further include a fuel tank, a cooling system, a milling fluid spray system, various kinds of circuitry and computer-related hardware, or any combination thereof. In some examples, the work machine 100 may be a milling machine or a reclamation machine. In other examples, the work machine 100 may be any other work machine that requires knowing the location of a point where a tool contacts a work surface.

FIG. 2 illustrates a schematic diagram of the control system 200 for the work machine 100. The work machine 100 can be controlled by one or more embedded or integrated controllers (hereinafter referred to as "controller 202"). The controller 202 can include one or more processors, microprocessors, microcontrollers, electronic control modules (ECMs), electronic control units (ECUs), programmable logic controllers (PLCs), or any other suitable means for electronically controlling functionality of the work machine 100.

The controller 202 can be configured to operate according to a predetermined algorithm or set of instructions for controlling the work machine 100 based on various operating conditions of the work machine 100, such as can be determined from output of any of the various sensors. Such an algorithm or set of instructions can be stored in a database 204, can be read into an on-board memory of the controller 202, or preprogrammed onto a storage medium or memory accessible by the controller 202, for example, in the form of a floppy disk, hard drive, optical medium, random access memory (RAM), read-only memory (ROM), or any other suitable computer-readable storage medium commonly used in the art (each referred to as a "database"), which can be in the form of a physical, non-transitory storage medium.

The controller 202 can be in electrical communication with or connected to a drive assembly 206, or the like, and various other components, systems or sub-systems of the work machine 100. The drive assembly 206 can comprise an engine, a hydraulic motor, a hydraulic system including various pumps, reservoirs, actuators, or combinations thereof, among other elements (such as the power source 104 of FIG. 1). By way of such connection, the controller 202 can receive data pertaining to the current operating parameters of the work machine 100 from sensors, such as, the sensor 130, the vertical motion sensor 140, the sensor 150, the one or more scanning sensor 160, and the like. In response to such input, the controller 202 can perform various determinations and transmit output signals corresponding to the results of such determinations or corresponding to actions that need to be performed, such as for changing at least one milling parameter. The at least one milling parameter can be cutting depth, cutting angle, cutting speed, machine speed, machine direction, or a combination thereof.

The controller 202, including a human-machine interface or an operator interface (hereinafter referred to as 'operator interface 208"), can include various output devices, such as screens, video displays, monitors and the like that can be used to display information, warnings, data, such as text, numbers, graphics, icons, and the like, regarding the status of the work machine 100. The controller 202, including the operator interface 208, can additionally include a plurality of input interfaces for receiving information and command signals from various switches and sensors associated with the work machine 100 and a plurality of output interfaces for sending control signals to various actuators associated with the work machine 100. Suitably programmed, the controller 202 can serve many additional similar or wholly disparate functions as is well-known in the art.

With regard to input, the controller 202 can receive signals or data from the operator interface 208 (such as at the control panel 122 of FIG. 1), the sensor 130, the vertical motion sensor 140, the sensor 150, the one or more scanning sensor 160, and the like. As can be seen in the example illustrated in FIG. 2, the controller 202 can receive signals from the operator interface 208. Such signals received by the controller 202 from the operator interface 208 can include, but are not limited to, an all-leg raise signal and an all-leg lower signal for the vertically-movable legs 108. In some embodiments, the vertically-movable legs 108 nearest the first end 102A of the frame 102 can be controlled individually directly, while the vertically-movable legs 108 nearest the second end 102B of the frame 102 are controlled together indirectly based on movements of the vertically-movable legs 108 nearest the first end 102A.

The controller 202 can also receive position or length data from each of the vertical motion sensor 140. As noted before, such data can include, but is not limited to, information as to the lengths of the vertically-movable legs 108 or the amount of extension or retraction of the vertically-movable legs 108. Such information can be used to determine an orientation of the frame 102 relative to the sensor 130 of the ground-engaging units 106.

The controller 202 can also receive data from one or more of the sensors 150 on either of the side plates 118 (FIG. 1) or on the inboard ski 113 (FIG. 1). Such data can include, but is not limited to, information related to the vertical position of the side plates 118, the angle or slope of the side plates 118, and/or whether the side plates 118 are in contact with the work surface 114. Such data can also be used to determine a difference in the height of the work surface 114 on either side of the milling rotor 112.

In other examples, such information can be provided by the grade and slope system 220, a hydraulic system controller or the like, to the controller 202. The operation status received can include whether the work machine 100 is in non-milling operational status or milling operational status (e.g., the milling rotor 112 is not spinning or the milling rotor 112 is spinning).

In examples, the grade and slope system 220 can receive and process data from the operator interface 208 related to the operator's desired depth of the cut, the slope of the cut, and the like. The grade and slope system 220 can receive a signal from one or more of the sensors 150. In examples, as discussed above, the sensor 150 can be connected to either, or both, of the side plates 118, connected to the inboard ski 113, or to any other component of the work machine 100. The grade and slope system 220 can also receive milling parameters, for example, machine speed, machine direction, machine grade, machine slope, milling speed, milling depth, milling angle, or any other parameter used in milling operations.

In examples, the grade and slope system 220 can use the received milling parameters, and the signals received from various other sensors (e.g., the sensor 130, the vertical motion sensor 140, the sensor 150, or the like), to maintain a grade and slope received from the operator interface 208. The grade and slope system 220 can maintain the grade and slope received from the operator interface 208 giving the operator of the work machine 100 one less milling parameter to control while operating the work machine 100.

In examples, the controller 202 can receive additional information from an image processor 230. The image processor 230 can be electronically connected to the one or more scanning sensor 160. As discussed above, the one or more scanning sensors 160 can be a camera configured to capture one or more images of the milling rotor 112. The image processor 230 can be configured to receive the one or more images from the one or more scanning sensor 160 and analyze the one or more images to determine a scratch height of the milling rotor 112 based on the one or more images.

The scratch height of the milling rotor 112 defines a height of the milling rotor 112 on condition that the milling rotor 112 is in contact with the work surface 114 (FIG. 1).

In one or more examples, the scratch height of the milling rotor 112 may be a height of the milling rotor 112 as one of the cutting tools 111 contacts the work surface 114. In another example, the scratch height of the milling rotor 112 may be a height of the milling rotor 112 as any part of the milling rotor 112 contacts the work surface 114. In yet another example, the scratch height of the milling rotor 112 may be a height of the milling rotor 112 as any part of the milling rotor 112 nominally contacts the work surface 114. For example, as the milling rotor 112 approaches the work surface 114, the point at which the cutting tools 111 or the milling rotor 112 first touches the work surface 114 satisfy a condition that the milling rotor 112 is in nominal contact with the work surface 114.

In some examples, the image processor 230 can compare the one or more images from the one or more scanning sensor 160 to one or more reference images stored on a database, for example the database 204. The one or more reference images may include images of a milling rotor in contact with a surface of a roadway. More specifically, the one or more reference images may include one or more images of a plurality of cutting tools on the milling rotor, for example, the cutting tools 111 on the milling rotor 112.

In another example, the image processor 230 may compare one or more images captured by the one or more scanning sensor 160 to of one or more reference images stored on a database, for example, the database 204. For example, the image processor 230 may compare the one or more images captured by the one or more scanning sensor 160 to one or more stored images that are known to be at a scratch height. For example, the image processor 230 may compare the one or more images captured by the scanning device 160 to one or more stored images showing the cutting tool 111 contacting the work surface 114. In another example, the image processor 230 may compare the one or more images captured by the scanning device 160 to one or more images with debris flying from the milling rotor 112. In one or more examples, the image processor 230 may compare the one or more images captured by the one or more scanning sensor 160 to one or more stored images showing debris flying from the work surface 114 that is indicative of the milling rotor 112 contacting the work surface 114. In yet another, the image processor 230 may compare the one or more images captured by the one or more scanning sensor 160 to one or more stored images of each of the above-discussed scenarios, or any other scenario that may be indicative that the cutting tool 111 or the milling rotor 112 is in contact with the work surface 114.

During the operation of the work machine 100 (e.g., cold planer, or a roadway milling machine), determining a scratch height can be necessary to recalibrate the grade and slope system 220. The scratch point is a height of the milling rotor 112 as cutting tools 111 of the milling rotor 112 contacts work surface 114. Conventionally, a first operator may be operating the work machine 100 from an operator's seat on the platform 120 (FIG. 1), while at least one other operator assists from the ground level, telling the operator operating the work machine 100 when the cutting tools 111 of the milling rotor 112 contacts the work surface 114.

In some examples, the scratch height may be found multiple times in a workday, daily, weekly, or once per job site to ensure the accuracy of the milling depth. Moreover, the cutting tools 111 of the milling rotor 112 can wear as the work machine 100 conditions the work surface 114. Thus, the more frequently a scratch height is determined, the more accurately the grade and slope system 220 can control the milling depth of the work machine 100. Thus, an automated operation that allows just a single operator to operate the work machine 100 can include a system configured to automatically detect a scratch height of the milling rotor 112 on condition that the milling rotor 112 is in contact with work surface 114.

Figure 3:
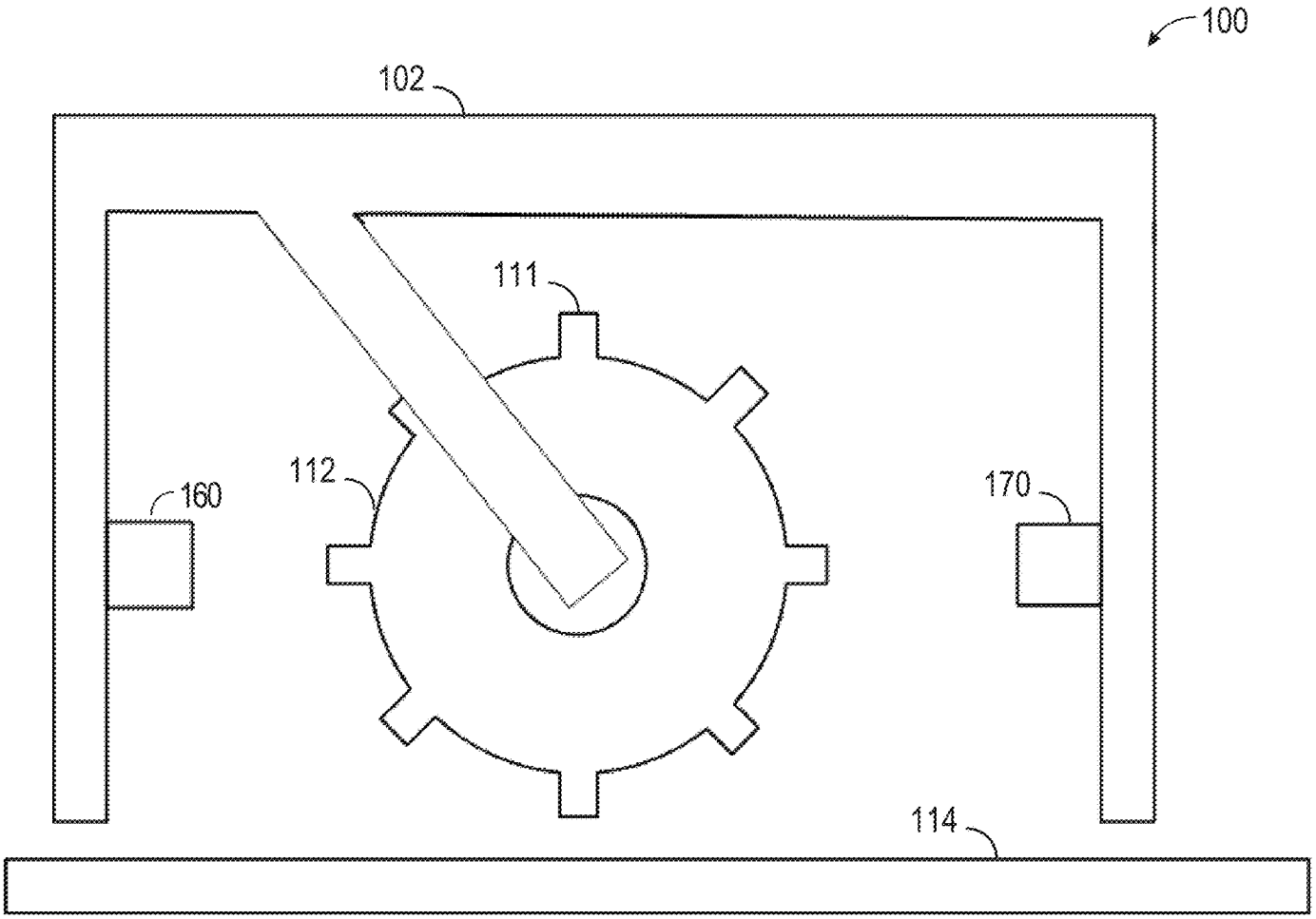
FIG. 3 is a schematic diagram of an example of a portion of a work machine.

FIG. 3 is a schematic diagram of an example of a portion the work machine 100. As shown in the example of FIG. 3, the milling rotor 112 can be attached to the frame 102. In one example, the milling rotor 112 can be rigidly attached to the frame 102 such that as the frame 102 moves with relation to the work surface 114, the milling rotor 112 moves with relation to the work surface 114. In another example, the milling rotor 112 can be pivotally attached to the power source 104 (FIG. 1) such that the control system 200 (FIG. 2) can move the milling rotor 112 with relation to the work surface 114 independently from the frame 102.

In the example of FIG. 3, the work machine 100 can include the one or more scanning sensor 160 attached to the frame 102 on one side of the milling rotor 112 and a light 170 attached to the frame 102 on another side of the milling rotor 112. The light 170 can be configured to illuminate the milling rotor 112 to improve contrast in the one or more images captured by the one or more scanning sensor 160. For example, the light 170 can shine on the milling rotor 112 to make it easier to see a gap between the cutting tools 111 of the milling rotor 112 and the work surface 114 as the milling rotor 112 approaches the work surface 114. As the cutting tools 111 of the milling rotor 112 contact the work surface 114 the light from the light 170 can be blocked by the cutting tools 111 helping the image processor 230 detect when the cutting tools 111 of the milling rotor 112 contacts the work surface 114.

As shown in FIG. 3, the one or more scanning sensor 160 can be mounted to the frame 102 on a side of the milling rotor 112 closer to first end 102A (FIG. 1) and the light 170 can be mounted to the frame 102 on a side of the milling rotor 112 closer to second end 102B (FIG. 1). In another example, the one or more scanning sensor 160 can be mounted to the frame 102 on a side of the milling rotor 112 closer to second end 102B, and the light 170 can be mounted to the frame 102 on a side of the milling rotor 112 closer to the first end 102A.

Figure 4:
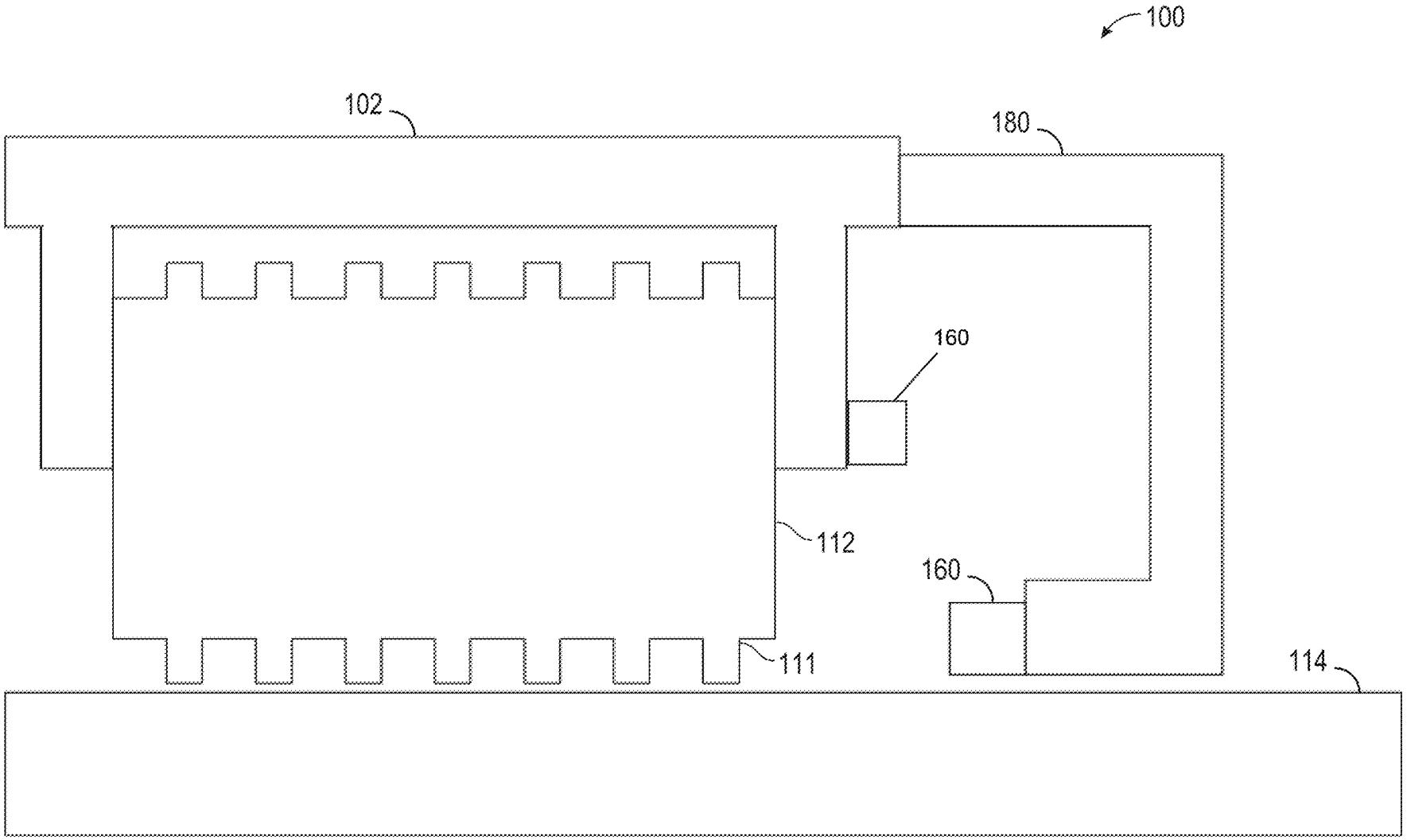
FIG. 4 is a schematic diagram of an example of a portion of a work machine.

FIG. 4 is a schematic diagram of another example of the work machine 100. As shown in FIG. 4, the work machine 100 can include a moveable boom arm 180 attached to the frame 102. The moveable boom arm 180 can be configured to have a stored position (not shown) where the moveable boom arm 180 can be retracted and stored near the frame 102 such as to not interfere with the operation of the work machine 100 and to protect any equipment attached to the moveable boom arm 180. For example, in a retracted position, the moveable boom arm 180 can be positioned next to the frame 102 and enclosed in a case (not shown). In another example, in a retracted position, the moveable boom arm 180 can be positioned within the frame 102 such that the frame 102 protects the moveable boom arm 180. The moveable boom arm 180 can be configured to be extended to a position exterior to the work machine 100. For example, the one or more scanning sensor 160 can be attached to the moveable boom arm 180 and the moveable boom arm 180 can extend away from the frame 102 to position the one or more scanning sensor 160 outside of the work machine 100 such as the one or more scanning sensor 160 can capture a side profile of the milling rotor 112 as the milling rotor 112 is approaching the work surface 114.

In another example (not shown in the figures), the work machine 100 can include another moveable boom arm (e.g., the moveable boom arm 180 from FIG. 4) attached to the frame (e.g., the frame 102) with a light (e.g., the light 170 from FIG. 5) attached thereto such that the light is opposite the milling rotor from the one or more scanning sensor attached to the other moveable boom arm (e.g., opposite the milling rotor 112 from the one or more scanning sensor 160 attached to the moveable boom arm 180, as shown in FIG. 4).

INDUSTRIAL APPLICABILITY

In one or more operable examples of the present disclosure, a scratch height for a machine (e.g., the work machine 100) can be found automatically without the need for a second operator on the ground level.

Figure 5:
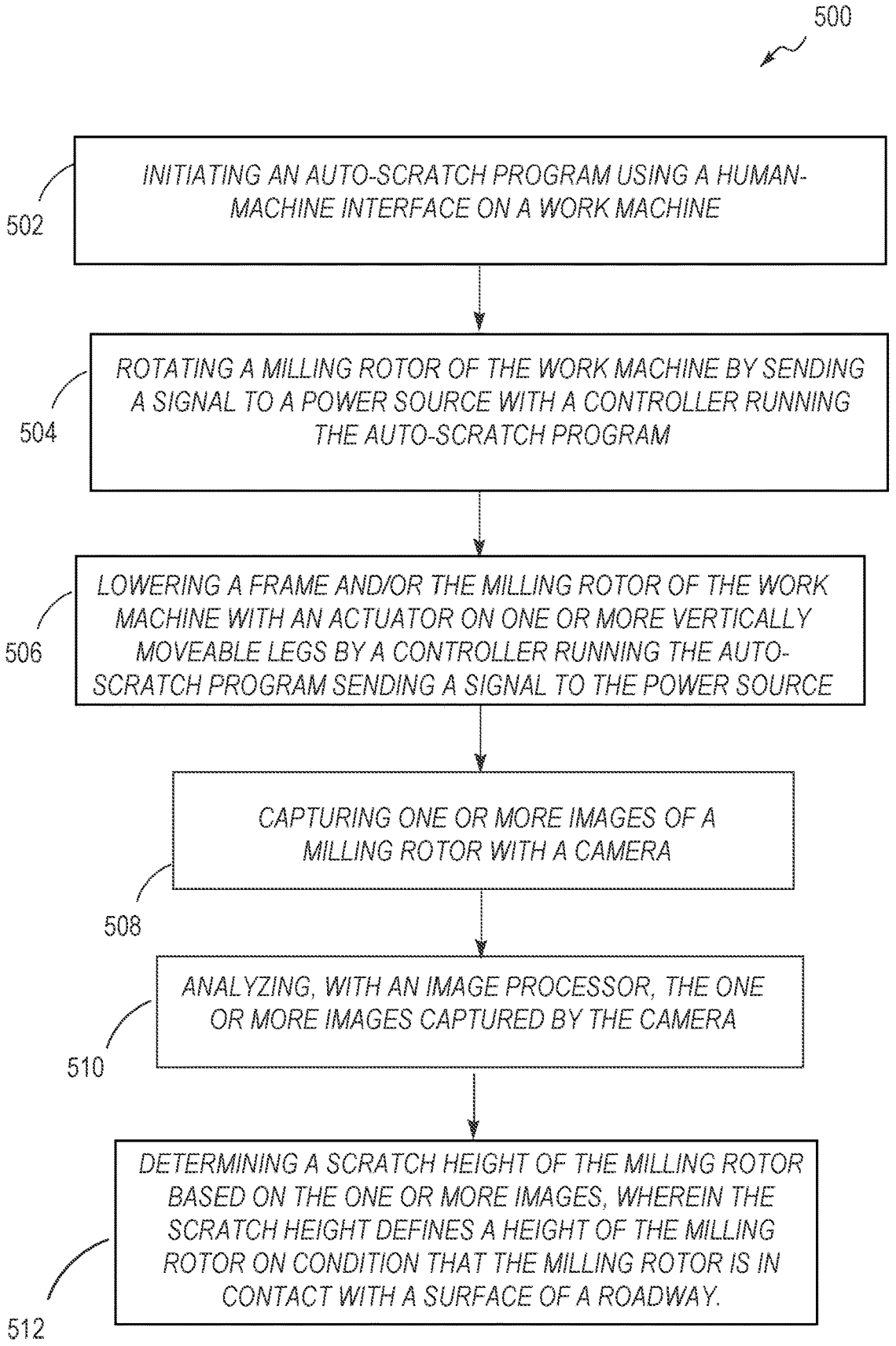
FIG. 5 is a schematic flowchart of an example of a work machine automatically determining a scratch height.

FIG. 5 is a schematic flowchart of an example of a work machine (e.g., the work machine 100) automatically determining a scratch height. The work machine can include a system to automatically determine a scratch height 500. The system to automatically determine a scratch height 500 can be configured to find the scratch height of the work machine without the help of a second operator on the ground level.

At step 502, the system to automatically determine a scratch height 500 can be initiated using a human-machine interface of a work machine. For example, an operator of the work machine 100 can initiate the auto scratch program by selecting an auto scratch button (not shown) on the operator interface 208 of the work machine 100.

At step 504, the system to automatically determine a scratch height 500 can include rotating a milling rotor of the work machine by sending a signal to a power source with a controller running the auto-scratch program. For example, once the auto scratch program is initiated, the controller 202 can send a signal to the power source 104 to begin rotating the milling rotor 112 of the work machine 100. Rotating the milling rotor 112 of the work machine 100 can help the system to automatically determine a scratch height 500 by detecting the moment the cutting tools 111 of the milling rotor 112 contact the work surface 114.

At step 506, the system to automatically determine a scratch height 500 can lower a frame and/or the milling rotor (e.g., the milling rotor 112) with actuators on one or more of the plurality of vertically moveable legs, or an actuator attached to the milling assembly, respectively, by a controller running the auto-scratch program sending a signal to the power source. For example, the controller 202 running the auto scratch program can send a signal to the power source 104 to lower the frame 102 and/or the milling rotor 112 toward the work surface 114. For example, the controller 202 can send a signal to the power source 104 to extend or retract actuators (not shown) respectively attached to one or more of the vertically-movable legs 108 to lower the frame 102 toward the work surface 114. In another example, the controller 202 can send a signal to the power source 104 to extend or retract an actuator (not shown) attached to the milling assembly 110 to lower the milling rotor 112 toward the work surface 114.

At step 508, the system to automatically determine a scratch height 500 can capture one or more images of the milling rotor with a camera, or any other perceptive sensor. For example, the controller 202 can send a signal to the one or more scanning sensor 160 to have the one or more scanning sensor 160 capture one or more images of the work surface 114.

At step 510, the system to automatically determine a scratch height 500 can analyze, with an image processor, the one or more images captured by the camera or perceptive sensor. For example, the controller 202 can have the image processor 230 run one or more programs to analyze the one or more images captured by the one or more scanning sensor 160 to determine whether the cutting tools 111 of the milling rotor 112 contact the work surface 114.

At step 512, the system to automatically determine a scratch height 500 by determining a scratch height of the milling rotor based on the one or more images captured by the camera or perceptive sensor. The scratch height may define a height of the milling rotor on condition that the milling rotor is in contact with a surface of the roadway. The system to automatically determine a scratch height 500 can then communicate the determined scratch height of the milling rotor to the controller 202 such that the controller 202 can communicate the scratch height to the grade and slope system 220. The grade and slope system 220 can update a stored scratch height value with the scratch height obtained by the system to automatically determine a scratch height 500 to measure a milling depth of the milling rotor 112 more accurately when the milling rotor 112 prepares the work surface 114.

The above-detailed description is intended to be illustrative, and not restrictive. The scope of the disclosure should, therefore, be determined with references to the appended claims, along with the full scope of equivalents to which such claims are entitled.

What is claimed is:

1. A machine for roadwork, the machine comprising:
- a frame;
- a power source;
- a milling rotor operatively connected to the power source and the frame;
- at least one camera, the at least one camera configured to capture one or more images of the milling rotor; and
- an image processor in communication with the at least one camera, the image processor configured to:
- analyze the one or more images of the milling rotor captured by the at least one camera; and
- determine a scratch height of the milling rotor based on the one or more images, wherein the scratch height defines a height of the milling rotor on condition that the milling rotor is in contact with a surface of a roadway.

2. The machine of claim 1, wherein the milling rotor comprises a plurality of milling bits disposed around a periphery of the milling rotor.

3. The machine of claim 2, further comprising:
- a controller in electrical communication with the image processor and the power source, the controller can communicate the determined scratch height to one or more system on the machine to enable the one or more systems on the machine to more accurately measure a milling depth of the milling rotor.

4. The machine of claim 3, wherein the controller comprises an auto-scratch program, and when running the auto-scratch program the controller:
- sends a signal to the power source, the signal to the power source causing the power source to rotate the milling rotor to help the image processor detect when the milling rotor contacts the surface of the roadway.

5. The machine of claim 4, further comprising:

a plurality of ground engaging units; and a plurality of vertically movable legs, each leg of the plurality of vertically movable legs connecting one of the plurality of ground engaging units to the frame, wherein the controller running the auto-scratch program can lower the frame of the machine and the milling rotor by actuating the plurality of vertically movable legs until the image processor detects the scratch height.

6. The machine of claim 5, further comprising:

at least one human-machine interface located proximate a machine operator seat, the at least one human-machine interface is in electrical communication with the controller, wherein an operator can select the auto-scratch program on the at least one human-machine interface to cause the controller to run the auto-scratch program.

7. The machine of claim 6, further comprising:

at least one light, wherein the at least one camera and the at least one light are respectively mounted to the frame on opposite sides of the milling rotor.

8. The machine of claim 7, further comprising:

a movable boom arm, extending from the machine, the at least one camera is attached to the movable boom arm such that the camera can capture a temporary ground-level view from a side of the machine.

9. The machine of claim 8, wherein the movable boom arm further includes:

a sensor configured to detect an extension and retraction of the movable boom arm, wherein the image processor can use the extension and retraction of the movable boom arm to calibrate the one or more images captured by the at least one camera.

10. A method of detecting auto scratch height on a work machine, the work machine including a frame, a power source, a milling rotor operatively connected to the power source and the frame, a camera configured to capture one or more images of the milling rotor, and an image processor in communication with the camera, the method comprising:

receiving, with the image processor, one or more images of the milling rotor captured by the camera;

analyzing, with the image processor, the one or more images captured by the camera;

determining, with the image processor, a scratch height of the milling rotor based on the one or more images, wherein the scratch height defines a height of the milling rotor on condition that the milling rotor is in contact with a surface of a roadway; and communicating the scratch height to a system of the work machine having a controller to enable the work machine to more accurately measure a milling depth of the milling rotor.

11. The method of claim 10, wherein the milling rotor comprises a plurality of milling bits disposed around a periphery of the milling rotor.

12. The method of claim 10, wherein the controller comprises an auto-scratch program, and when running the auto-scratch program the controller:

sends a signal to the power source, the signal to the power source causing the power source to rotate the milling rotor to help the image processor detect when the milling rotor contacts the surface of the roadway.

13. The method of claim 12, wherein the work machine further comprises:

a plurality of ground engaging units; and a plurality of vertically moveable legs, each leg of the plurality of vertically moveable legs connecting one of the plurality of ground engaging units to the frame.

14. The method of claim 13, further comprising:

lowering the frame and the milling rotor of the work machine with the controller running the auto-scratch program by sending a signal to the power source to actuate the plurality of vertically moveable legs until the image processor detects the scratch height.

15. The method of claim 14, wherein the work machine comprises a movable boom arm with the camera attached to the movable boom arm such that the camera can capture a temporary ground-level view from a side of the work machine, the method further comprising:

sending a signal via the controller to the power source to actuate the movable boom arm to move the movable boom arm to the side of the work machine so that the camera is pointed toward the milling rotor;

capturing an image, using the camera, of the milling rotor; and detecting the scratch height when the milling rotor contacts the surface of the roadway.

16. The method of claim 15, further comprising:

detecting a position of the movable boom arm via a sensor configured to detect a position of the movable boom arm; and calibrating the image captured by the camera with the image processor by using the detected position of the movable boom arm.

* * * * *